United States Patent [19]

Bentsen

[11] Patent Number: 4,798,041

[45] Date of Patent: Jan. 17, 1989

[54] LINK BAG AND OPENING FIXTURE

[75] Inventor: Per Bentsen, Suffern, N.Y.

[73] Assignee: Minigrip, Inc., Orangeburg, N.Y.

[21] Appl. No.: 11,926

[22] Filed: Feb. 6, 1987

[51] Int. Cl.[4] ..... B65B 43/12

[52] U.S. Cl. ..... 53/468; 53/384; 53/459; 53/570

[58] Field of Search ..... 53/371, 376, 384, 469, 53/476, 480, 481, 570, 51, 558, 459

[56] References Cited

U.S. PATENT DOCUMENTS

| | | | |
|---|---|---|---|
| 3,559,874 | 2/1971 | Titchenal et al. . | |
| 3,599,388 | 8/1971 | Feingold | 53/570 X |
| 4,354,337 | 10/1982 | Mori et al. | 53/558 X |
| 4,490,959 | 1/1985 | Lems | 53/384 X |
| 4,514,962 | 5/1985 | Ausnit . | |
| 4,598,529 | 7/1986 | Pongrass et al. | 53/570 X |
| 4,665,552 | 5/1983 | Lems et al. | 53/570 X |

FOREIGN PATENT DOCUMENTS

| | | | |
|---|---|---|---|
| 2712390 | 9/1978 | Fed. Rep. of Germany | 53/570 |
| 2812798 | 9/1978 | Fed. Rep. of Germany | 53/570 |
| 2906301 | 8/1986 | Fed. Rep. of Germany | 53/570 |

*Primary Examiner*—James F. Coan
*Assistant Examiner*—Steven P. Weihrouch
*Attorney, Agent, or Firm*—Hill, Van Santen, Steadman & Simpson

[57] ABSTRACT

An apparatus for processing a bag chain to fill individual reclosable bags therealog with the chain having spaced rocket openings along the top including a sprocket for interengaging with the openings to draw the chain forwardly and to vertically support the chain, bag top spreader members including idler sprockets interengageable with the chain holes to vertically support the chain with pads opposite the idler sprockets to pull the bag tops open, means for controlling the distance the bag top is opened, and a common drive for pulling the bag chain forwardly and operating the bag opening means.

14 Claims, 3 Drawing Sheets

LINK BAG AND OPENING FIXTURE

BACKGROUND OF THE INVENTION

The present invention relates to improvements in bag handling apparatus for flexible plastic film bags, and more particularly to an apparatus for manually processing a bag chain with the chain having sprocket holes along the top and the mechanism having sprocket wheels supporting the chain, drawing the chain forward and means for opening individual bags for filling and for closing them.

Plastic bags made of thin plastic film with closures at the top have been developed and are available commercially in chains which permit individual bags to be cut or torn from the chains. Such bag chains are used with power driven machinery wherein they are opened, filled and individual bags removed from the chain and are also utilized in manually operated machinery wherein the operator can fill and remove a single bag or a plurality of bags to fill a current demand.

These bags utilize pressure closable elements at the top which have the general form of a rib at one side of the bag top with a groove at the other side and the rib and groove are interengageable and closable to seal the bag by the application of lateral pressure pressing the rib into the groove. Such closures are either attached to the bag or made integral therewith and can be inexpensively and conveniently made by being extruded integrally and monolithically with a plastic bag.

When a plurality of bags are joined in a chain for convenience of storage and handling, at the time the bags are to be utilized, optimumly the chain of bags is supported vertically and pulled fowardly usually incrementally one bag at a time with the bag being opened, filled and closed by pressing the rib and groove closure elements together. The bag when then filled is torn or cut from the bag chain.

Various means have been provided for drawing the bag forwardly and various means have been employed for supporting the bag chain vertically such as by providing supports beneath the bag or by providing the bag chain with projecting ribs along the top and with supporting guides that have grooves into which the ribs project to support the bags.

A feature of the present invention is to employ unique means for both supporting and advancing the bag by providing a series of holes or perforations along the bag top spaced to be engaged by the teeth of sprocket wheels. These sprocket wheels are driven to advance the bag chain and when the teeth are interengaged in the sprocket holes, the bag chain is vertically supported by the sprocket.

It is accordingly an object of the present invention to provide an improved method and apparatus for supporting and advancing a bag chain utilizing a series of spaced sprocket holes along the tops of the bag chain with the sprocket holes coacting with sprockets for processing the chain.

A further object of the invention is to provide a new and unique apparatus and method for handling a bag chain moving it along a path, opening individual bags for filling and closing them and advancing the chain and cutting off a filled bag from the chain.

A still further object of the invention is to provide an improved apparatus particularly well adapted for utilization by individuals who will manually operate the mechanism and where the mechanism is capable of advancing a bag chain automatically opening and closing an individual bag so that one or only a few bags can be advanced and filled and removed from the chain and wherein the operation can be accomplished by a simple single manually operated drive.

Other objects, features and advantages of the invention will become more apparent with the disclosure of the preferred embodiments thereof in the specification, claims and drawings, in which:

DESCRIPTION OF THE PREFERRED EMBODIMENTS

A chain 10 of individual bags such as 11, 12 and 13 is illustrated in FIGS. 1 through 6. The individual bags are interconnected at their top edges to form the chain and the bags are separated along their side edges so that a simple cut across the top edge will sever and separate individual bags.

The top edge of the bags are thickened and have perforations 14 extending therethrough uniformly spaced so as to be engaged by the teeth sprocket wheels. Below this top portion are interengageable rib and groove elements 15 which can be separated by pulling the top edges of the bag apart and which can be engaged to seal the bags by pressing together so that the rib enters the groove and is interlocked therein. It will be recognized that various forms of reclosable rib and groove fastener elements may be employed and that the simplified form of the elements at 15 is illustrated as a useful arrangement but without limitation.

Figure 1:
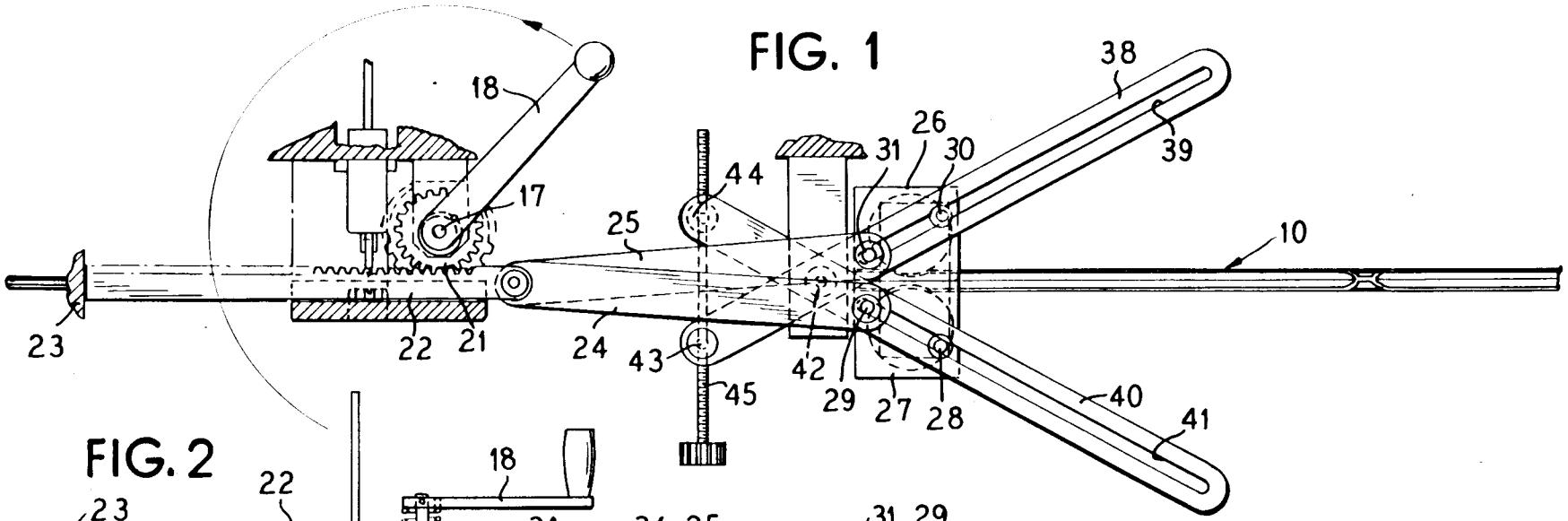
FIG. 1 is a top plan view, partially in section of a bag handling mechanism constructed and operating in accordance with the principles of the present invention.
Figure 2:
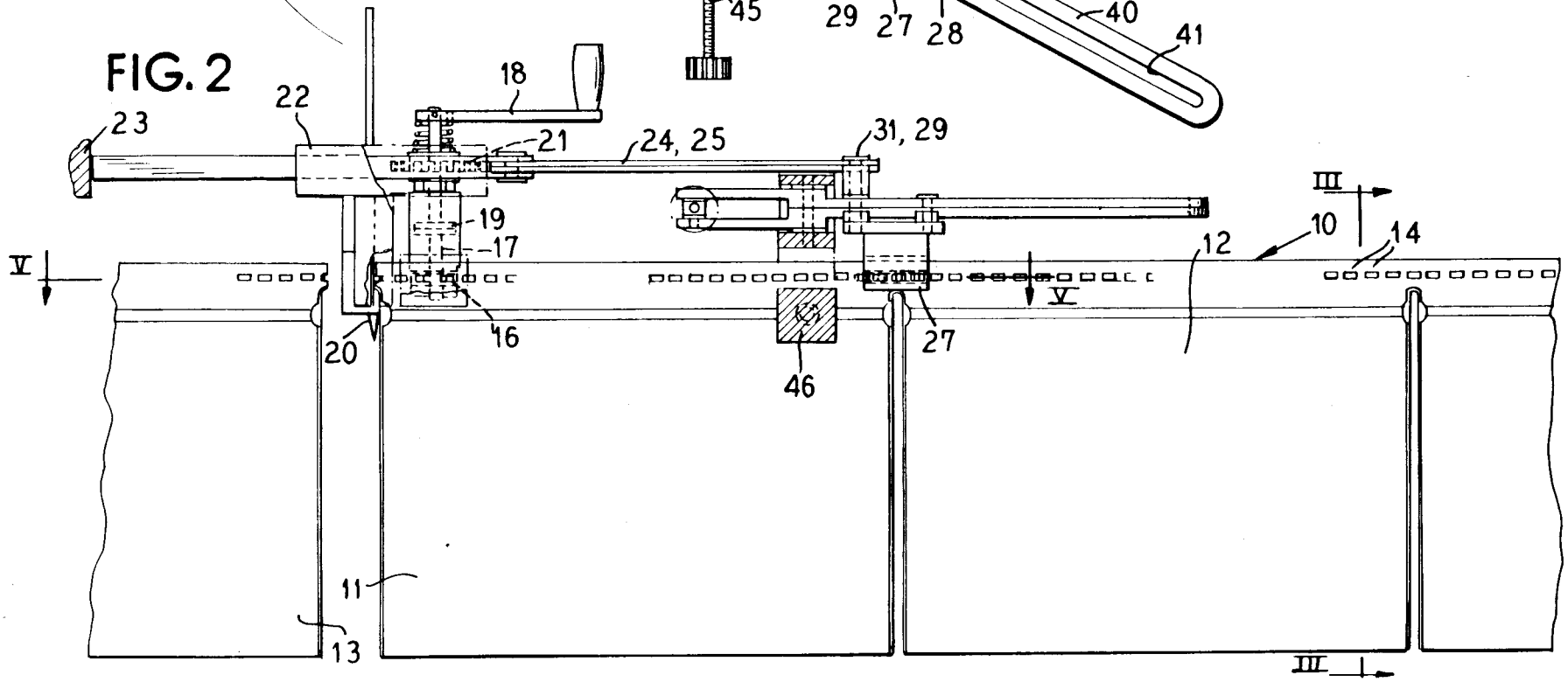
FIG. 2 is an elevational view of the mechanism of FIG. 1.
Figure 4:
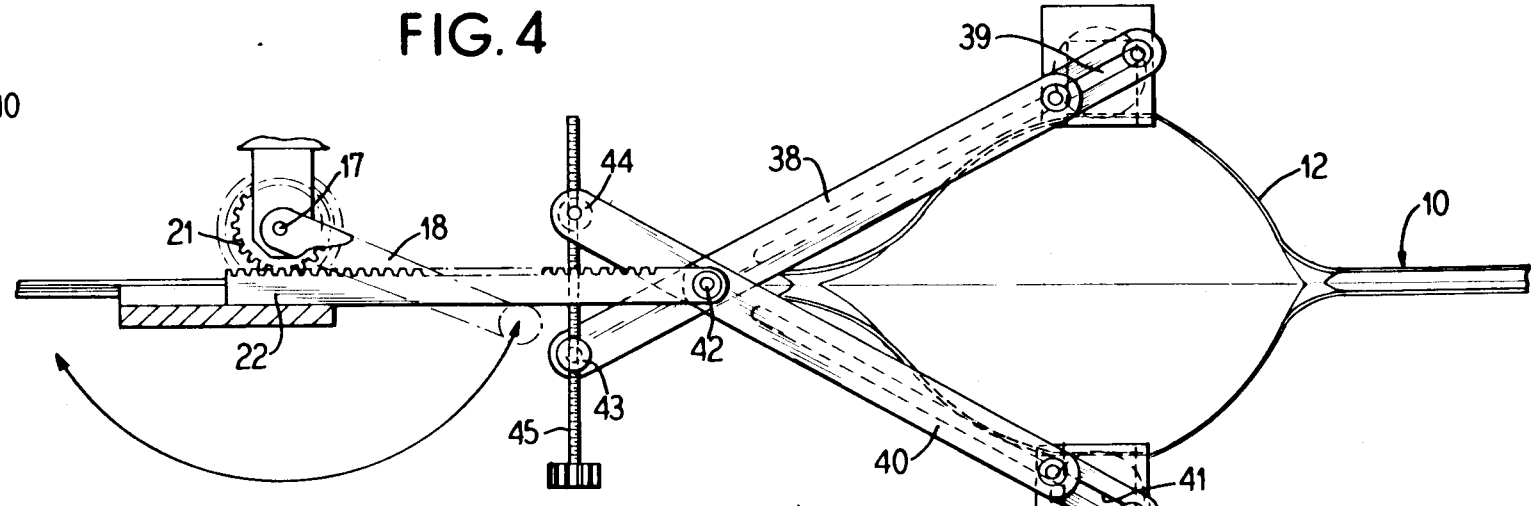
FIG. 4 is a top plan view of the structure of FIG. 1 with portions removed illustrating the opening of a bag top.
Figure 3:
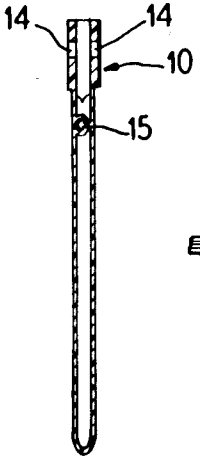
FIG. 3 is a vertical sectional view taken substantially along line III—III of FIG. 2 illustrating the structure of the bag chain in vertical section.
Figure 5:
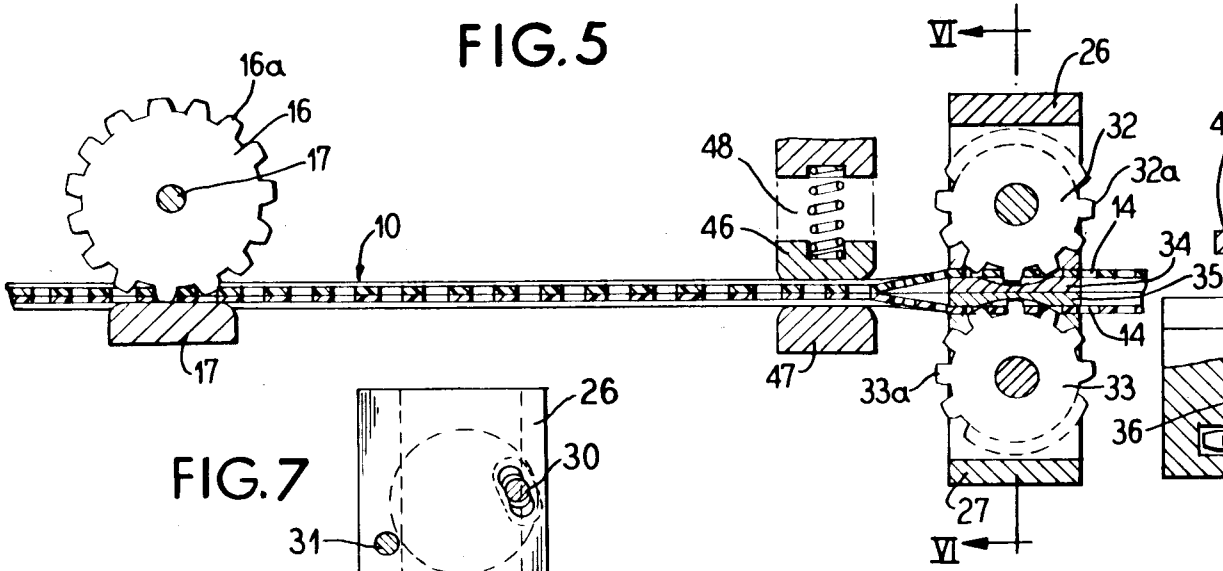
FIG. 5 is a horizontal sectional view taken substantially along line V—V of FIG. 2.

A driving and supporting sprocket wheel 16, FIGS. 2 and 5 has teeth 16a projecting into the holes or perforations 14 along the top of the bag. The sprocket 16 is supported on a vertical axis so that the chain of bags will hang on the teeth of the sprocket and yet as the sprocket rotates, it will pull the chain forwardly which is to the left in FIGS. 1, 2, 4 and 5.

The sprocket wheel on its vertical shaft 17 is manually driven such as by a crank arm 18. Various forms of drives may be employed but the features of the invention are particularly well adapted to a manually operated apparatus and can particularly well accommodate removal of only one or a few bags as the need arises. In the structure illustrated, the sprocket wheel 16 is driven by the crank 18 through a one-way clutch 19. The one-way clutch provides that when the sprocket handle is rotated in a clock-wise direction, the sprocket wheel 16 will be driven, but when turned in the opposite or counter-clockwise direction as illustrated in FIG. 1, the sprocket wheel 16 will not be driven and the forward motion of the bag chain will be halted. Only clockwise rotation of the crank will move the bag chain 10 forwardly.

The purpose of the one-way clutch is to permit spreader apparatus to separate the top edges of an individual bag for filling. This is accomplished by moving the crank arm 18 in a counter-clockwise direction and the shaft 17 carries a pinion 21 engageable with a rack 22. The rack 22 is connected to the base end of arms 24 and 25, FIG. 1. These arms drive spreader blocks 27 and 26, which blocks when pushed to the right, separate along straightline paths determined by cam track arms 40 and 38. The blocks have means thereon for gripping the opposed top edges of individual bags to spread them, as shown in FIG. 4, and to again bring them back together as shown in FIG. 5.

Figure 6:
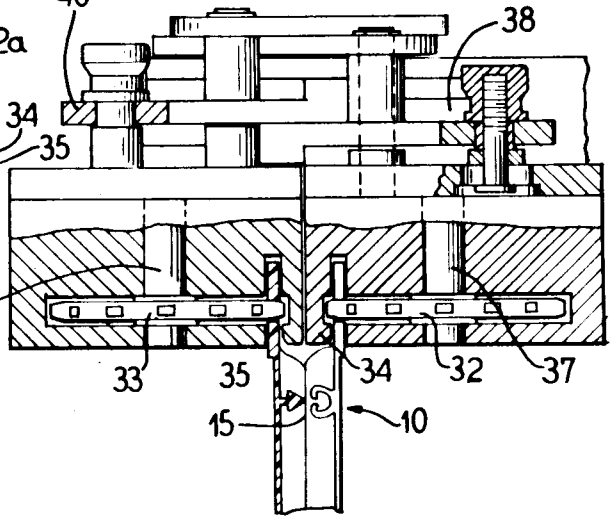
FIG. 6 is a vertical sectional view taken substantially along line VI—VI of FIG. 5.
Figure 7:
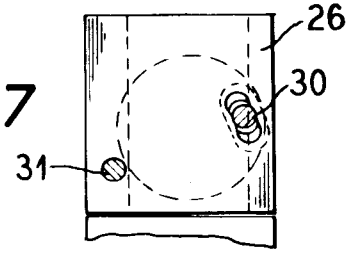
FIG. 7 is a detailed fragmentary view of one of the spreader members for the bag top.

The blocks have follower pins 29 and 28 and 31 and 30 which slide in cam slots 41 and 39 of the arms 40 and 38, FIGS. 1 and 7. Thus, when the blocks are moved to the right, the follower pins 29 and 28 and 31 and 30 slide along the tracks to cause the blocks to move in a diverging path from the position shown in FIG. 1 to the position shown in FIG. 4. Carried rotatably in the blocks are idler sprocket wheels 32 and 33, as shown in FIG. 5. These sprocket wheels are mounted on vertical idler shafts 36 and 37, as shown in FIG. 6. The idler sprocket wheels 32 and 33 have peripheral teeth which interengage with the sprocket holes 14 in the manner shown in FIGS. 5 and 6. Opposing the idler sprocket wheels 32 and 33 are downwardly projecting flanges 34 and 35 which slide along the inner surface of the top edges of the bags and insure continued interengagement of teeth of the sprocket wheels 32 and 33 with the sprocket holes in the bag chain.

Thus, as the rack 22, FIG. 1, is moved to the right, the arms 25 and 24 push the blocks 26 and 27 along the cam slots 39 and 40 and the flanges 34 and 35, in conjunction with idler sprockets 32 and 33 as shown in FIG. 6 spread the tops of the bags. If the rib and groove elements 15 are interlocked, the spreading of the bag tops will pull them apart and the top of the bag would be opened in the manner shown in FIG. 4 so that contents can be dropped down into the bag.

When the crank arm 18 is rotated in the opposite direction, that is clockwise, the rack 22 is pulled to the left in FIG. 1 until it engages the stop 23. A slip clutch (not shown) is located below the pinion so that the crank arm 18 can continue being cranked in a clockwise direction for advancing the bag chain to the position of FIGS. 1 or 2. During the movement of the rack 22 to the left, the blocks 26 and 27 will be pulled to the left in a converging direction, as shown in FIG. 1. This will cause the idler sprocket wheels 32 and 33 to ride along the outer surfaces of the bag top and pull the bag top edges toward each other to the position of FIG. 5.

Continued advance of the bag chain to the left, as shown in FIG. 5 will pull the rib and groove elements at the top of the bag between closer pads 46 and 47. These pads are urged toward each other by the pad 46 being backed by a compression spring 48, and the inner smooth sliding surfaces of the pads 46 and 47 will press the rib and groove elements into interengagement to close the top of the now filled bag. The bag will then have reached the position shown at 11 in FIG. 2. The crank must now be rotated in a counter-clockwise direction which will move the rack forward, which in turn will open the bag shown at 12. Thereafter, the crank is rotated in a clockwise direction and the bag shown at 12 moves to the location of the bag shown at 11, while the bag shown at 12 gets severed from the chain. Continued rotation of the crank arm 18 in the clockwise direction will pull the bag 11 to the position of bag 13 whereupon a knife 20 can sever the filled and closed bag from the chain. The knife 20 can either be activated to cut across the upper joined part of the bag chain, leaving the sprocket holes on the upper part of what have now become the bag opening lips, or cut below the sprocket holes, thereby separating the section containing the sprocket holes and joining the bags from the bags themselves.

Depending upon the items to be filled in the bag and the size of the bags used, the present arrangement allows for adjustment of the width that the bag top is to be opened as shown in FIG. 4. For this purpose, the cam arms 38 and 40 are pivoted at 42 and their pivotal position is controlled by a spreader adjustment rod 45 which threads into bosses 43 and 44 on the cam arms. As will be observed from FIGS. 1 and 4, rotation of the threaded rod 45 will change the angle of divergence and movement of the cam arms and thereby control the width that the bag top is opened.

In operation, the operator will first turn the crank arm 18 in a counter-clockwise direction which will move the rack 22 to a predetermined adjustable stop position which in turn will move the blocks 26 and 27 to the right along the cam arms 38 and 40 thus spreading the top edges of a bag 12 as shown in FIG. 4. The contents of the bag are then filled and the operator then begins to turn the crank arm to the right in a clockwise direction which both advances the bag train by rotating the sprocket 16 in a clockwise direction, being driven by the one-way clutch 19. This also pulls the rack 22 to the left pulling the blocks 26 and 27 to converge to bring the edges of the bag together. As the bag train is drawn forwardly, the rib and groove are joined by being pulled between the pads 46 and 47, FIG. 5. Continued pulling of the bag train brings the bag out to the position of bag 13 of FIG. 2 where it is cut from the train.

Figure 8:
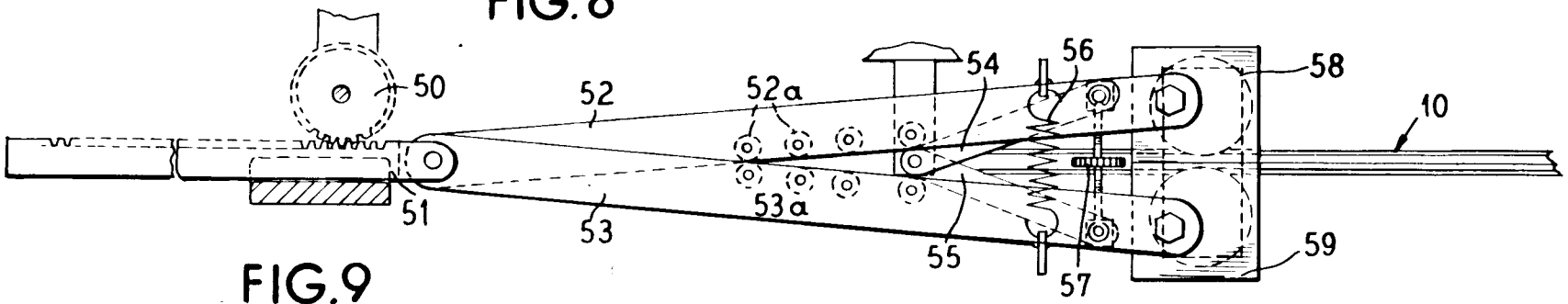
FIG. 8 is a top plan view of a modified form of the bag handling device.
Figure 9:
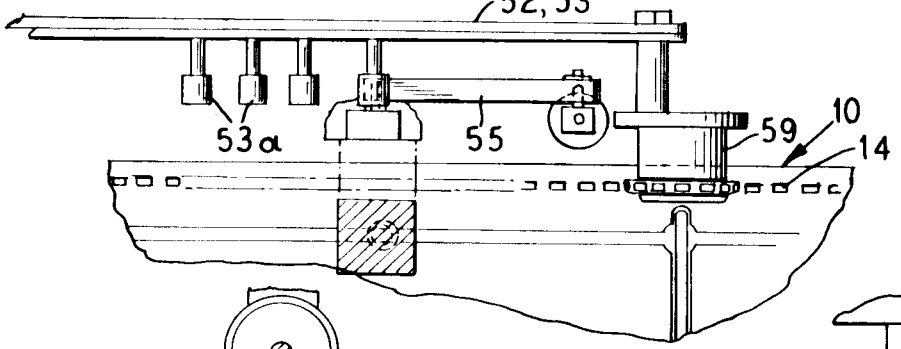
FIG. 9 is a fragmentary elevational view of the structure of FIG. 8.
Figure 10:
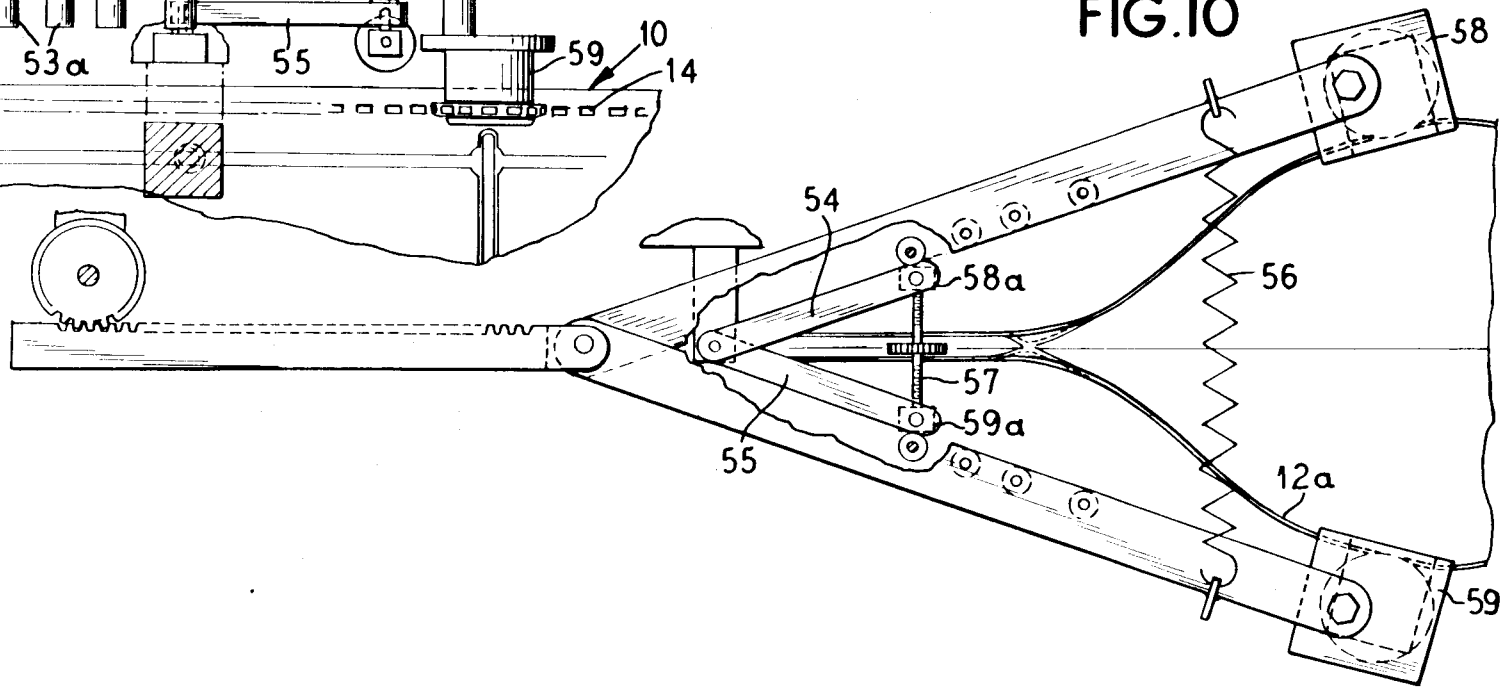
FIG. 10 is a plan view of the mechanism of FIG. 8 illustrating a bag top being opened.

In the arrangement of FIGS. 8 through 10, a modified form of arrangement for opening the bag is provided. A pinion 50 drives a rack 51 with the pinion being driven by a crank, not shown, but constructed similar to the crank shown in FIG. 1. The rack 51 is pivotally connected to a pair of arms 52 and 53 which carry blocks 58 and 59 at their ends and the blocks have means for holding the top edges of the bags so as to separate the top edges, as shown in FIG. 10 or to bring the top edges together as shown in FIG. 8.

As the rack 51 moves to the right pushing the arms 52 and 53 to the right, the arms are separated from the position of FIG. 8 to the position of FIG. 10. This is accomplished by follower rollers **52*a* and 53*a* on the arms 52 and 53 in that the follower rollers ride along on the outer surfaces of cam bars 54 and 55. A plurality of rollers 52*a* and 53*a* are provided so that contact is maintained with the cam bars for the full travel of the rack. The cam rollers 52*a* and 53*a* are held against the cam bars 54 and 55 because of a tension spring 56 connected across the arms 52 and 53. The tension spring exerts a constant pull to urge the arms toward each other so that the follower rollers 52a and 53a will follow down the outer surfaces of the cam bars 58a and 59a when the rack moves to the left as it does in FIG. 8**.

In operation of the arrangement of FIGS. 8 through 10, when a previous bag has been filled and advanced and removed from the chain, the next bag is in position for opening and filling, and the rack 51 is driven to the right so that the follower rollers 52a and 53a ride along and out on the outer surfaces of the cam bars 54 and 55. This spreads the arms 52 and 53 to separate the blocks 58 and 59 and thus open the bag 12a in the manner shown in FIG. 10. After the bag has been filled, the rack 51 is moved to the left and the spring 56 pulls the arms 52 and 53 together with the blocks 58 and 59 urging the bag top together. The blocks will be constructed similar to the blocks in FIGS. 1 through 5 having idler sprocket wheels engaging the sprocket holes 14 in the bag chain and thus supporting the bag chain. The blocks also will have an inner flange to slide along the inside of the bag top. Thus, the bag chain is supported horizontally by the combination of sprocket wheels. With reference to FIG. 5, it will be seen that continual engagement with sprocket holes in the bag chain is maintained by the sprocket 16 and by the idler sprocket wheels 32 and 33. Since the idler sprocket wheels 32 and 33 are laterally spaced, a stable vertical support is applied to the bag chain to maintain it upright and this allows for the forward drive sprocket wheel 16 to engage from one side only applying a vertical supporting force to the bag chain.

The structure is simple in operation and all parts are readily accessible for servicing and adjustment. The adjustment permits control of the width of opening of the bag top to accommodate filling a bag with different size objects. The mechanism is well adapted for manual operation in a small shop or store where possibly only one bag may be filled and removed or only a few bags. Also, the structure with its features of reliability and simplicity can be used for production operation. Thus, it will be seen that there has been provided an improved bag handling and operating mechanism which meets the objectives and advantages above set forth and provides for an improved handling and filling operation for reclosable bags with sprocket openings at the top.

I claim as my invention:

1. An apparatus for processing a bag chain to fill individual reclosable bags with spaced sprocket openings along the top, comprising in combination:

an advancing sprocket wheel rotatable about a vertical axis and having peripheral teeth for engaging with correspondingly spaced sprocket holes along the top edge of a bag chain for vertically supporting the chain and for advancing the chain along a path;

first drive means for driving the wheel intermittently to advance the bag chain while continuing the vertical support;

spreader members engageable with opposed top edges of individual bags of said chain and being laterally relatively spreadable relative to said path for opening the top edges of a bag and again closable to release the top edges, said spreader members each having idler sprocket wheels with peripheral teeth for engaging with the sprocket holes along the top edge of the bag for supporting the bag at a location spaced from said advancing sprocket wheel;

second drive means operating the spreader members;

and a closer having pressing elements applying a lateral force to the bag top for interengaging rib and groove elements on the bag to close the bag with the closer located in a position after said spreader members along said path.

2. An apparatus for processing a bag chain to fill individual reclosable bags with spaced sprocket openings along the top, constructed in accordance with claim 1:

and including a pad in the path having a lateral facing bag chain engaging surface positioned laterally opposite said sprocket wheel for insuring full engagement of said sprocket wheel teeth with the sprocket holes in the bag chain.

3. An apparatus for processing a bag chain to fill individual reclosable bags with spaced sprocket openings along the top, constructed in accordance with claim 1:

wherein said closer includes opposed laterally facing pads with sliding surfaces engaging opposing sides of the top of the bag chain for applying said lateral force.

4. An apparatus for processing a bag chain to fill individual reclosable bags with spaced sprocket openings along the top, constructed in accordance with claim 1:

including means for adjustably controlling the total movement of said spreader members to control the width to which the top of the bag is opened.

5. An apparatus for processing a bag chain to fill individual reclosable bags with spaced sprocket openings along the top, constructed in accordance with claim 1:

wherein said first and second drive means are interconnected and operable by a common driving force means.

6. An apparatus for processing a bag chain to fill individual reclosable bags with spaced sprocket openings along the top, constructed in accordance with claim 1:

wherein said spreader members are movable along a cam means between a first position wherein the top edges of a bag are brought together and a second position wherein the top of the bag edges are spread to open the bag.

7. An apparatus for processing a bag chain to fill individual reclosable bags with spaced sprocket openings along the top, constructed in accordance with claim 6:

wherein said cam means is in the form of tracks extending along arms which are angled from an outer position to an inner position in the direction of said path.

8. An apparatus for processing a bag chain to fill individual reclosable bags with spaced openings along the top comprising in combination:

an advancing sprocket wheel rotatable about a vertical axis and having peripheral teeth for engaging with correspondingly spaced sprocket holes along the top edge of a bag chain for vertically supporting the chain and for advancing the chain along a path;

first drive means for driving the wheel intermittently to advance the bag chain while continuing the vertical support;

spreader members engageable with opposed top edges of individual bags of said chain and being laterally relatively spreadable relative to said path for opening the top edges of as bag and again closable to release the top edges;

said spreader members including pads facing in a direction for engaging the inner surface of the top edges of the individual bags and including outer idler sprockets laterally opposite the pads with peripheral teeth engaging the holes in the bag top;

second drive means operating the spreader members;

and a closer having pressing elements applying a lateral force to the bag top for interengaging rib and groove elements on the bag to close the bag with the closer located in a position after said spreader members along said path.

9. An apparatus for processing a bag chain to fill individual reclosable bags with sprocket openings along the top, comprising in combination:

an advancing sprocket member positioned with laterally extending tooth projections for engaging with sprocket openings in a bag chain to pull the bag chain of interconnected bags along a path for supporting the chain vertically;

a spreader means movable laterally of said path engageable with the top edges of an individual bag in the chain for opening said bag so that the bag may be filled and being positioned after said sprocket member in said path, said spreader means each having idler sprocket wheels with peripheral teeth for engaging with the sprocket holes along the top edge of the bag for supporting the bag at a location spaced from said advancing sprocket wheel;

and a closure means positioned between said spreader means and said sprocket member applying a lateral closing force to the bag top for interengaging facing rib and groove elements on the bag to close the bag.

10. An apparatus for processing a bag chain to fill individual reclosable bags with spaced sprocket openings along the top, constructed in accordance with claim 9:

wherein said sprocket member and said spreader means are driven intermittently by a common drive.

11. The method of processing a bag chain to fill individual reclosable bags having spaced sprocket openings comprising the steps:

supporting the bag chain on spaced sprocket wheels rotatable about vertical axes including an advancing sprocket wheel pulling the bag chain and idler sprocket wheels spaced from the advancing sprocket wheel;

spreading the lips of individual bags for filling the bag at the first station applying the idler wheels to support the bags at said first station;

and closing the bags at a second station while advancing the bags by rotation of the advancing sprocket wheel.

12. The method of processing a bag chain to fill individual reclosable bags with spaced sprocket openings along the top in accordance with the steps of claim 11:

wherein individual bags are severed from the bag chain after being filled and closed.

13. The method of processing a bag chain to fill individual reclosable bags with spaced sprocket openings along the top in accordance with the steps of claim 11:

wherein the bags are opened by spreader means applying a laterally outwardly directed force to the bag top for opening the bag.

14. The method of processing a bag chain to fill individual reclosable bags with spaced sprocket openings along the top in accordance with the steps of claim 11:

wherein the bags are closed at the closing station by being forcibly moved forward between closely spaced closing pads which apply a laterally inwardly directed force to the sides of the bag top.

* * * * *